US006514144B2

(12) United States Patent
Riendeau et al.

(10) Patent No.: US 6,514,144 B2
(45) Date of Patent: Feb. 4, 2003

(54) ONLINE GAME OF CHANCE PROVIDING A MULTI-PLAYER EXTENSION OF A SINGLE-PLAYER VIRTUAL SCRATCH TICKET GAME AND A METHOD OF PLAYING THE GAME

(75) Inventors: Timothy Riendeau, Ledyard, CT (US); John DeTora, Ashaway, RI (US); Matthew McAllister, E. Greenwich, RI (US); Sharon Gannon, North Kingstown, RI (US); Jasmin Blackmar, Cranston, RI (US); Clifton Dutton, Providence, RI (US)

(73) Assignee: GTECH Corporation, West Greenwich, RI (US)

( * ) Notice: Subject to any disclaimer, the term of this patent is extended or adjusted under 35 U.S.C. 154(b) by 27 days.

(21) Appl. No.: 09/872,960

(22) Filed: Jun. 1, 2001

(65) Prior Publication Data

US 2001/0049305 A1 Dec. 6, 2001

Related U.S. Application Data

(60) Provisional application No. 60/209,121, filed on Jun. 2, 2000.

(51) Int. Cl.[7] ..... A63F 9/24

(52) U.S. Cl. ..... 463/42; 463/18; 463/17

(58) Field of Search ..... 463/16, 17, 18, 463/19, 20, 21, 22, 30, 31, 37, 40, 42; 273/236, 269, 272, 274, 292

(56) References Cited

U.S. PATENT DOCUMENTS

| | | | | |
|---|---|---|---|---|
| 4,468,037 A | * | 8/1984 | Kuhn | 273/295 |
| 4,764,666 A | | 8/1988 | Bergeron | 235/380 |
| 5,791,991 A | | 8/1998 | Small | 463/41 |
| 5,935,002 A | | 8/1999 | Falciglia | 463/19 |
| 6,152,824 A | | 11/2000 | Rothschild et al. | 463/42 |
| 6,179,713 B1 | | 1/2001 | James et al. | 463/42 |
| 6,196,920 B1 | | 3/2001 | Spaur et al. | 463/42 |
| 6,220,596 B1 | | 4/2001 | Horan | 273/269 |
| 6,227,974 B1 | | 5/2001 | Eilat et al. | 463/40 |

* cited by examiner

*Primary Examiner*—Chen-Wen Jiang
(74) *Attorney, Agent, or Firm*—Kenyon & Kenyon

(57) ABSTRACT

An online game of chance that produces a multi-player extension to an individual, instant lottery-type game and a method of playing the game are disclosed. The game comprises a first, individual phase of play using a virtual game substrate and a second, group phase of play comprising a plurality of virtual game substrates from first phase of play that are arrayed in a matrix. The first, individual phase of play is based on in instant lottery version of the well-known game of tic-tac-toe; the object being to match a plurality of game pieces, e.g., three, in one of a contiguous row, column, and diagonal. The object of the second phase of play is to use the combination of virtual game substrates to produce a match with one or more predetermined winning array combinations. This provides each individual participant with a second chance of winning. With the second phase of play, the combination of virtual game substrates is also movable, which produces even more opportunities for participants to win a prize.

17 Claims, 4 Drawing Sheets

ONLINE GAME OF CHANCE PROVIDING A MULTI-PLAYER EXTENSION OF A SINGLE-PLAYER VIRTUAL SCRATCH TICKET GAME AND A METHOD OF PLAYING THE GAME

REFERENCE TO RELATED APPLICATIONS

The present invention claims a right of priority to provisional application serial No. 60/209,121 entitled "Game of Chance", which was filed in the United States Patent and Trademark Office on Jun. 2, 2000.

FIELD OF THE INVENTION

The present invention relates to an online game of chance and a method of playing the game. More precisely, the invention relates to a multi-player extension of an instant-type ticket game that is played online by a plurality of participants, the game having a first, individual playing phase and a second, team or group playing phase for which prizes can be awarded for each phase of play.

DESCRIPTION OF THE RELATED ART

As in many areas of commerce, the emergence and proliferation of the Internet has revolutionized gaming, making it possible for those who cannot physically access traditional "brick and mortar" type gaming facilities, e.g., Off-Track Betting or pari-mutuel offices, casinos, river boats, and the like to experience the thrill and excitement that can accompany games of chance "virtually", which is to say in cyber-space. Indeed, the number of U.S. patents issued in U.S. Classification 463 in the last few years lends credence to the growing popularity and need of online games of chance.

For example, patents have been issued for online gaming architecture, e.g., U.S. Pat. No. 6,152,824 to Rothschild, et al. Architecture patents, such as the one to Rothschild, et al., typically disclose a networked computer system to for online gaming that couples a plurality of client, or player, computers to a plurality of server computers. Patents also have been issued for interactive game systems, e.g., U.S. Pat. No. 6,227,974 to Eilat, et al. Interactive game systems, such as the one to Eilat, et al., typically enable a first player to compete against a second player on a network via a communication link. Indeed, there are even patents covering online game playing with advertising, e.g., U.S. Pat. No. 6,196,920 to Spaur, et al., and patents for online gaming using integrated circuit, i.e., "smart", cards for payment, e.g., U.S. Pat. No. 4,764,666 to Bergeron.

In general, online games can be played individually or can be played by a plurality of players. Individual games pit the participant against "the machine" or "the house". However, the only real excitement created during play is that which accompanies winning the game. Moreover, individual games do not necessarily require a network to play, as participants can play a game on their own personal computer.

Multiple player games, on the other hand, can include (i) multiple players (but usually just two) playing the same game on the same computer; (ii) multiple players (but usually just two) playing the same game on remote computers using, e.g., modems and a telephone line; and (iii) multiple players (generally up to about 16) playing the same game on remote computers using, e.g., a local area network (LAN), a wide area network (WAN), and/or the Internet. In each of these embodiments of multiple-player games, participants vie against "the machine" and each other, which adds an additional layer of excitement to the gaming experience. Furthermore, depending on the playing network, the number of participants playing at one time can reach anywhere from about 16 for LAN and WAN networks to about 100 or more for Internet networks.

One example of a networked, multiple-player game is disclosed in U.S. Pat. No. 6,179,713 to James, et al. The James, et al. patent discloses a turn-based, multiple-player, Internet game for a large number of participants in which participants input moves in turn, i.e., sequentially. A salient feature of the James, et al. patent, however, is that participants are allowed to change moves during a turn. A problem with the James, et al. patent is that the game is time-consuming. Hence, some participants can lose interest and abort playing the game, which may leave a "hole" or "open chair" in the game. Furthermore, the rules of the game are quite complex.

SUMMARY OF THE INVENTION

Accordingly, it would be desirable to produce an online, multiple-layer game of chance and a method of playing the game that provide advantages not found in the prior art.

Therefore, it is an object of this invention to produce an online, multiple-player game of chance and a method of playing the game that embrace an easy-to-understand format and that are relatively quick to play.

It is a further object of this invention to produce an online, multiple-player game of chance and a method of playing the game that produces an individual phase and a group phase of play, in which one or more participants can win in either or both phases.

These and further objects are obtained by an online, multiple-player game of chance and a method of playing the game, wherein the game includes a first game phase comprising a virtual scratch substrate, having a grid, which includes a plurality of playing squares arrayed in a plurality of rows, columns, and diagonals, disposed thereon; and a second game phase comprising a matrix, the matrix comprising an array of a plurality of virtual scratch substrates from the first game phase disposed thereon. Participants can win a prize during the first game phase if at least three matching game pieces, which are disposed in the playing squares of the grid, are arrayed in at least one contiguous row, column, or diagonal in the grid. Furthermore, participants can win a prize during the second game phase if a combination of game pieces, when arrayed in the matrix, matches one or more predetermined winning arrays of game pieces.

Additionally, the present invention includes a method of playing an online game of chance comprising the steps of (i) providing one or more participants with one or more virtual scratch game substrates, the substrates having a plurality of game pieces disposed in a grid thereon that are concealed from view by a virtual covering; (ii) playing a first game phase, in which participants remove the virtual coverings from the virtual scratch game substrate to reveal their individual game pieces, to determine whether their game substrate is a winning substrate; and (iii) playing a second game phase in which a plurality of virtual scratch game substrates of more than one players are combined and arrayed in a matrix, to determine whether said combination of game substrates is a winning combination of game substrates.

BRIEF DESCRIPTION OF THE DRAWINGS

For a fuller understanding of the nature and desired objects of the present invention, reference is made to the following detailed description taken in conjunction with the accompanying figures wherein like reference character denote corresponding parts throughout the several views and wherein.

DETAILED DESCRIPTION OF THE INVENTION AND ITS PREFERRED EMBODIMENTS

The present invention relates to an online game of chance and a method of playing the game. Preferably, the game produces a multiple-player extension of a single player instant-type scratch ticket game both of which are played over a network. While a preferred embodiment of the game will be described as being played over the Internet, it should be noted that the game can be played equally as well over a LAN, WAN, wireless network, e.g., a personal desk assistant (PDA), interactive television, and the like without violating the scope and spirit of this disclosure.

Figure 1:
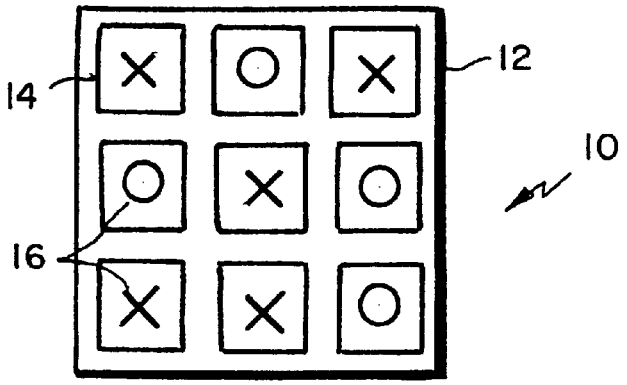
FIG. 1 is an illustrative embodiment of a virtual game substrate.

The first, or individual, phase of the game is played using a modified version of the well-understood and globally recognized tic-tac-toe format. The elements comprising the first phase of the game will be described by referring to FIG. 1. Indeed, each participant is provided with one or more virtual game substrates 10, which, preferably, comprise a grid 12 having a number of playing squares 14 arranged in a number of columns or rows. In a preferred embodiment the grid 12 is a three-by-three (3×3) grid 12, having a total of nine playing squares 14 arrayed in three columns and three rows of three playing squares 14 each. It is important to note, that the number of rows and columns making up the grid 12 can be more than three and/or the number of rows does not have to be the same as the number of columns.

Preferably, the playing squares 14 of the grid 12 on each virtual game substrate 10 contain game pieces 16, which are concealed from view by a virtual covering (not shown) until a participant purposely removes the virtual covering. The object of the first phase of the game, of course, being to uncover a combination of matching game pieces 16, e.g., X's, that are contiguous to one another in one or more rows, columns, and/or diagonals. According to the game of the present invention, prizes are awarded for each "three-in-a-row" appearing in the grid 12 on the game substrate 10.

Figure 2:
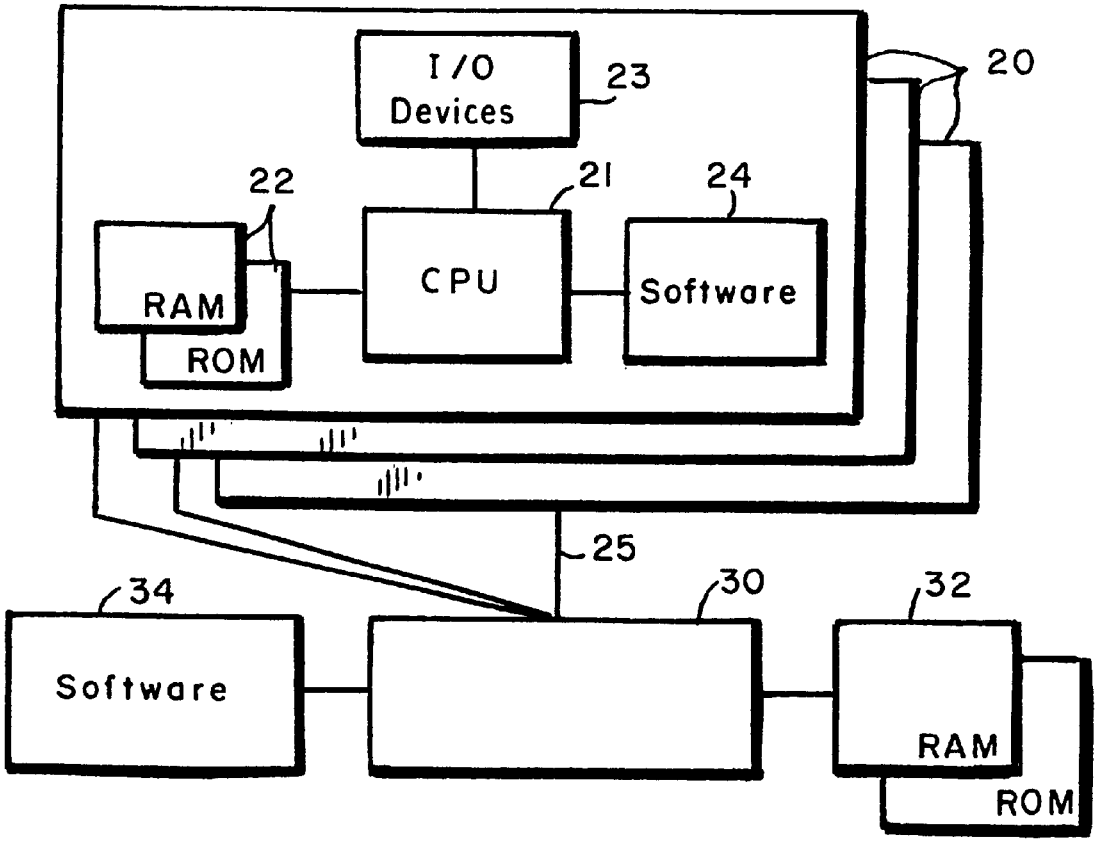
FIG. 2 is an illustrative embodiment of a network for playing the online game of chance.
Figure 3:
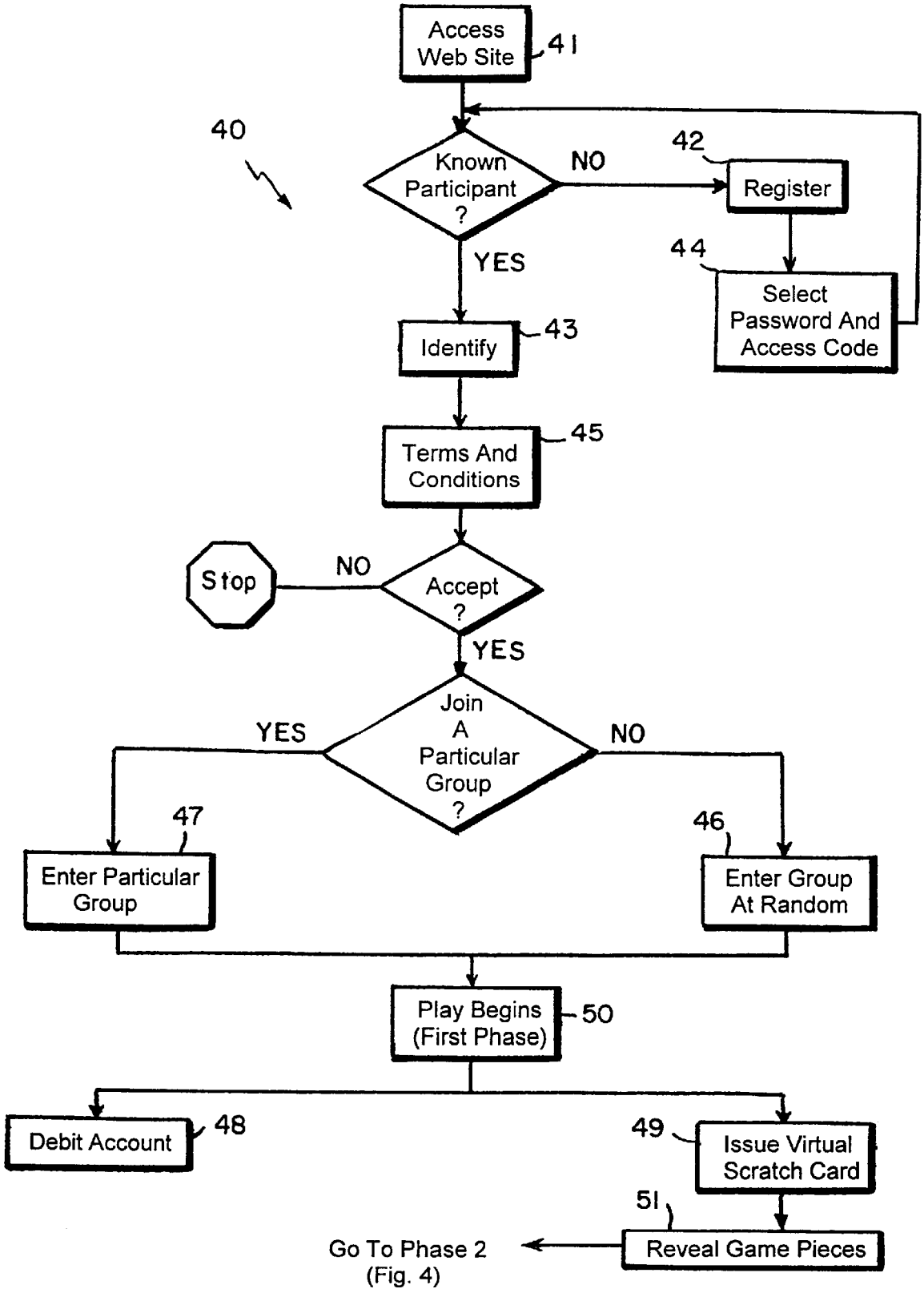
FIG. 3 is an illustrative embodiment of a method of playing the first phase of the game.

The method of playing the first phase of the subject game 40 will now be described using FIGS. 2 and 3. To play the game, participants preferably need a, e.g., computer system 20 that includes a central processing unit 21, data memory 22, e.g., random access memory (RAM) and/or read only memory (ROM), one or more input/output (I/O) devices 23, e.g., a display screen, printer, mouse, and/or trackball, and Web browser software 24. The Web browser software 24 enables participants to communicate with a game server 30 over a network 25, e.g., the Internet, in general, or the World Wide Web, specifically. For example, Web browser software 24 enables participant computer systems 20 to transmit data to the game server 30; receive data from the game server 30, e.g., in hyper-text markup language (HTML); and display that data, e.g., on a display screen 23, in a human readable format.

Preferably, the game server 30, which can include a combination of one or more servers, includes data memory 32, e.g., RAM and/or ROM, and supporting software for hosting a plurality of games 34. For example, supporting software 34 can include software that provides each participant with one or more virtual game substrates 10; combines a plurality of participants into a playing group; records and displays the plays affected by participants; determines whether any participants have won a prize and the amount of that prize; credits and/or debits participants' accounts; and communicates with a plurality of participant computer systems 20.

After a participant has accessed, i.e., downloaded, the game server's Web site 41, software in the game server 34 transmits data, e.g., via an interrupt message, to participant's computer system 20 that requests the participant to register 42, if a first time (unknown) visitor, or to identify him- or herself 43, if a repeat visitor. To register 42, a participant provides responses to queries for personal information, e.g., name, address, email address, telephone number, credit card number, and the like. Typically, participants respond to these queries using a keyboard, mouse, and/or trackball 23. Once a participant has provided the requisite information, he or she is prompted to select and provide a unique password/passphrase and an access code or personal identification number (PIN) 44. The game server 30 uses the password/passphrase and access code or PIN on all subsequent visits by the participant to identify the participant.

Furthermore, prior to the start of play, the game server provides each participant with the rules, regulations, terms, and conditions of playing the game 45, including, without limitation, an explanation on how fees for playing are handled, e.g., by debiting the participant's credit card account that is provided during registration 42. Participants signify that they accept these conditions of play by clicking on the appropriate button 54. If a participant chooses not to abide by the rules, regulations, terms, and conditions of play, then the program ends 55.

Participants, preferably, then are afforded the option of joining a playing group at random 46, or, in the alternate, creating and/or joining a particular group of familiar participants 47, e.g., who have logged on to the game server's Web site contemporaneously to play together as a group. If a participant does not want to join a particular group, then the game server software 34 automatically and randomly places a plurality of participants in a group 46. Preferably, this is done on a first come, first served basis. If, on the other hand, a participant indicates that he or she wants to play with a particular group of familiar participants 47, he or she preferably provides a group name and, optionally, a password. The group name either creates an address in memory to which subsequent familiar participants will be directed or which directs familiar participants to the playing group at that address. The password allows a particular group to prevent uninvited participants from accessing the playing group.

For example, participant A agrees to play a game with her eight friends B, C, D, E, F, G, H, and I at a particular time using a group name of FRIENDS. At the appointed time, participant A logs on and accesses the Web site 41; and registers 42 and/or identifies herself 43; and accepts the terms and conditions of play 45 as described above. When prompted whether she wants to play with a particular group, participant A clicks on the button for the affirmative and then either enters the group name FRIENDS in an appropriate location provided therefor, e.g., using a keyboard, or double clicks on FRIENDS when it appears in a window containing a menu of group names. Here again, to preclude uninvited guests from entering a group, a password, which is known only to the familiar participants, can be used.

After at least four participants have entered a random or a pre-planned playing group, the game server 30 connects all of the participants into a common network 25 and the first phase of play 40 can begin. Preferably, a playing group contains at least four but no more than nine participants. However, fewer than four participants can play in a playing group without violating the scope and spirit of this disclosure. Moreover, in a separate embodiment, participants can have more than one game substrate in a particular playing group.

The playing groups having been set, the game server 30 preferably provides each participant with at least one virtual game substrate 49. Concurrent with providing a participant with a game substrate 49, the game server 30 debits each participant's, e.g., credit card, account the prescribed fee for playing the game 48.

Figure 4:
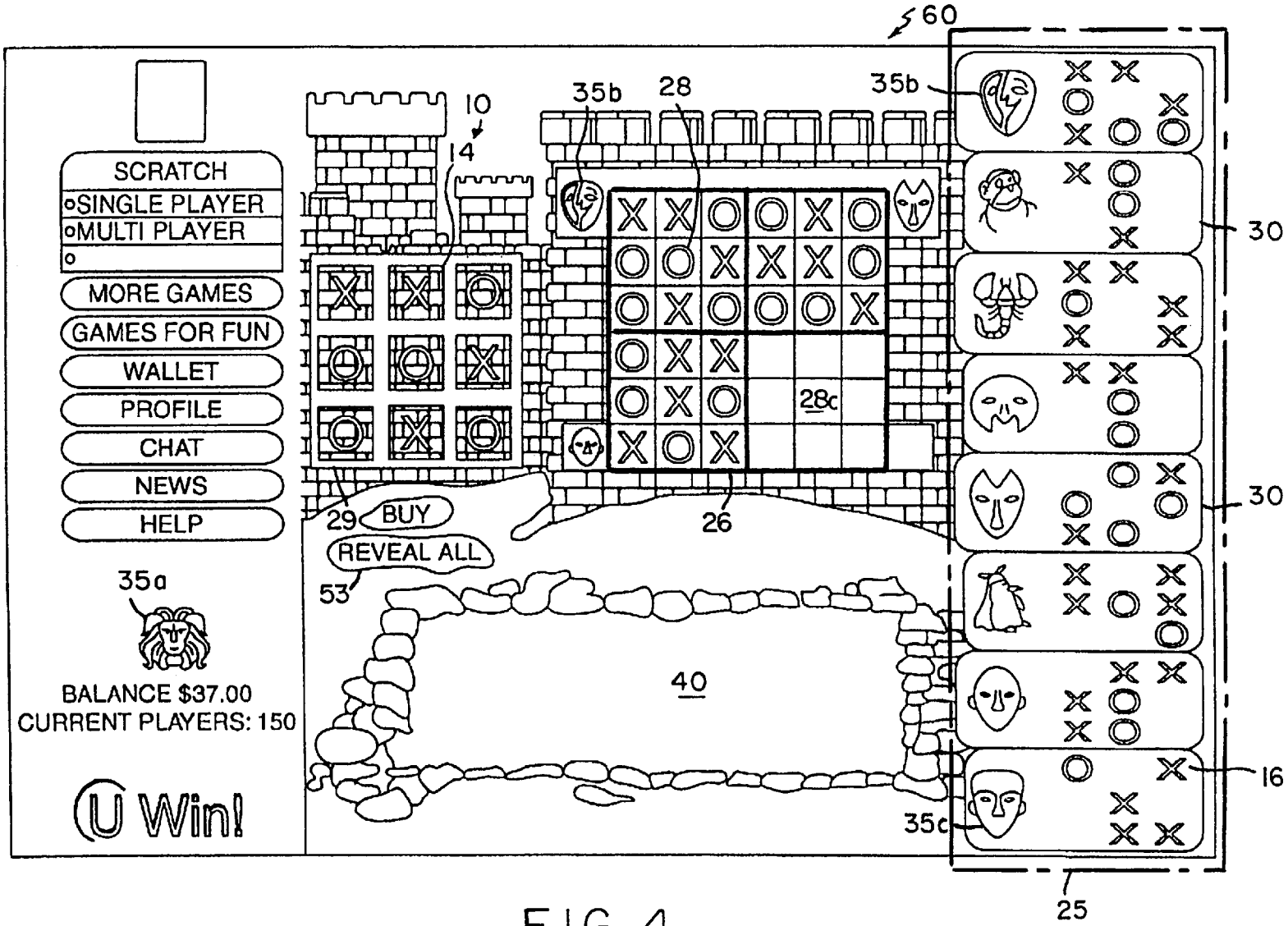
FIG. 4 is an illustrative embodiment of an online, multiple-player game of chance.

Preferably, the virtual game substrate 10 is displayed in a first area 29, e.g., on the display screen 60 of the participant's computer system 20. An illustrative embodiment of a computer screen display 60 in accordance with the present invention is shown in FIG. 4. Preferably, the virtual game substrates of each of the other playing group participants 30 are displayed in a second area 25 of the screen display 60 so that each participant can observe his or her own game substrate 10 and those of the other participants 30. More preferably, the virtual game substrates of the other participants 30 appear smaller in overall dimension than the participant's own game substrate 10, making it easier to differentiate between one's own 10 and another's game substrate 30. To further facilitate identification of game substrates, the participant's, e.g., name, nickname, and/or avatar 35*a*, 35*b*, 35*c* can be displayed adjacent to his or her game substrate 10. For example, the participant having the virtual game substrate 10 shown in FIG. 4 is represented by a lion's head avatar 35*a*.

The initial phase of play comprises the systematic removal, e.g., by pointing and clicking with a mouse, of the virtual covering that conceals all of the game pieces 16, e.g., X's and O's, that are disposed in each of the playing squares 14 on all of the game substrates 10 and 30. One participant, randomly selected by the game server 30, has the first choice of determining which playing square 14 on his or her virtual game substrate 10 to "scratch off". As the game is turn-based, each participant, subsequently, receives a sequential turn, scratching off one of his or her own playing squares 14. This continues until each participant has revealed one game piece 16 and, ultimately, until all of the game pieces 16 disposed in playing squares 14 of all of the game substrates 10 and 30 have been revealed. After a participant has designated a playing square 14 to uncover, the game server 30 uncovers the game piece 16 disposed therein from the participant's game substrates 10 as well as from each of the other players' substrates 30. Consequently, at a glance, a participant can see how other participants are faring.

Participants are awarded a prize each time they uncover matching game pieces 16, e.g., three X's, that produce at least one three-in-a-row either horizontally, vertically and/or diagonally on their individual game substrates 10. Game server software 34 determines the amount of each prize and records the participant who won it. Prize amounts are stored in a memory database 32, e.g., in a participant's game account, which can be placed "on account" to be used to offset future game fees and/or from which a check or money order in the amount of the prize can be drafted and issued to the participant.

Figure 5:
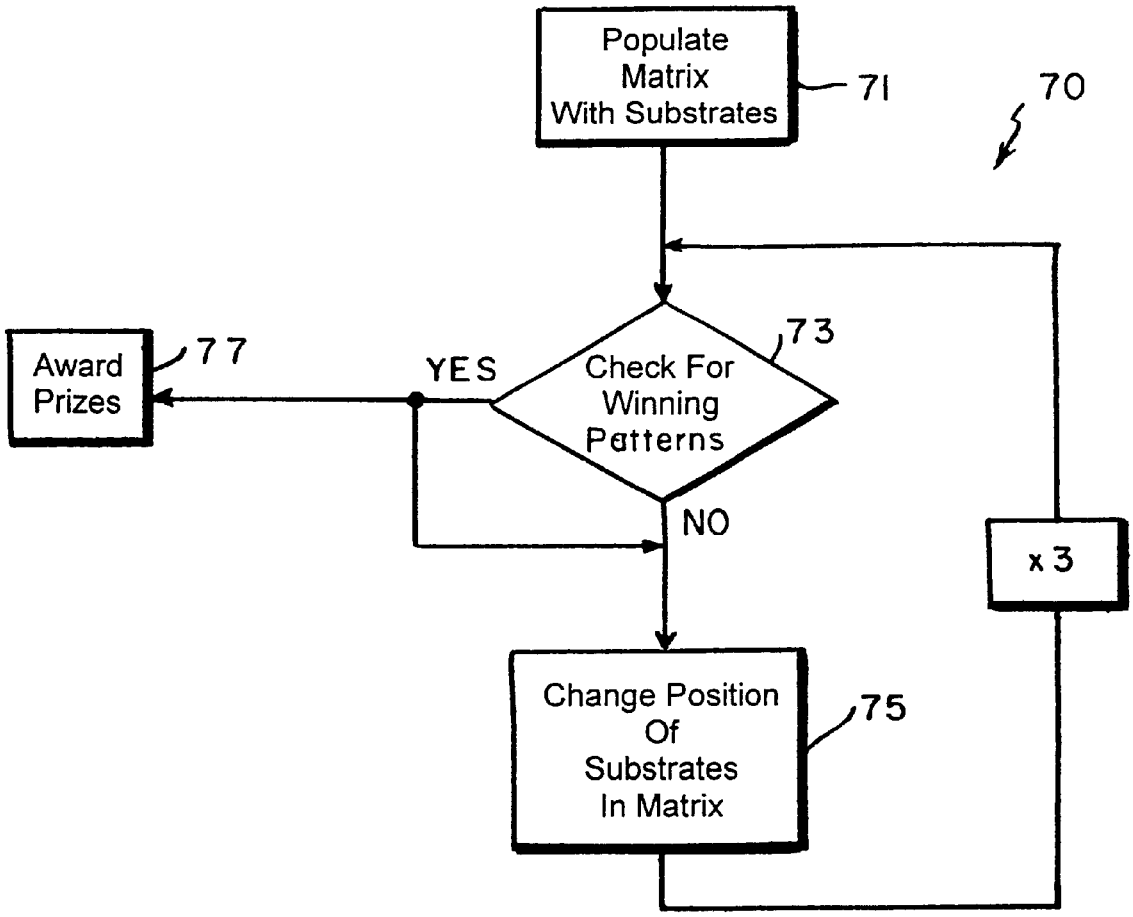
FIG. 5 is an illustrative embodiment of a method of playing the second phase of the game.

As mentioned above, first phase play continues until all of the game pieces 16 on all of the game substrates 10 and 30 have been uncovered. After all of the game pieces 16 have been uncovered, participants preferably enjoy a second chance of winning a prize. See FIG. 5. Indeed, a second, or group, phase of play 70 begins during which the game substrates 10 of a plurality of, e.g., four, participants are combined 71 to populate a similar plurality of quadrants 28 of a matrix 26, which is shown in a preferred embodiment in FIG. 4 as a six-by-six (6×6) matrix 26. The object of the second phase of play 70 is again to match a combination of game pieces 16 with one or more winning patterns. For example, winning patterns can vary and can include a row, column, or diagonal of the same game piece 16 (XXXXXX), alternating game pieces 16 (XOXOXO), bookend game pieces 16 (XOOOOX), and/or half-and-half game pieces 16 (XXXOOO). The possible winning patterns do not have to follow any apparently ordered format. Indeed, the winning patterns can be randomly selected for each playing group.

In a preferred embodiment, the game server 30 disposes the game substrates 10 of each combination of, e.g., four, randomly selected participants taken from a single playing group into one of the four quadrants 28 of the matrix 26, which is to say the upper left, the upper right, the lower right 28*c*, and the lower left. After a combination of four is so disposed, the game server 30 searches the plurality of rows, columns, and diagonals to identify any that match the one or more winning patterns 73. Then each game substrate 10 is rotated 75, e.g., clockwise, one quadrant 28 of the matrix 26 and the game server 30 again searches for and identifies any matching patterns 73. This process of rotating the game substrates one quadrant 28 clockwise and searching for matching patterns 73 is continued for two more cycles so that all four of the substrates 10 have populated all four of the quadrants 28.

Prizes for matching one or more of the winning patterns are divided among the four participants 77 on, e.g., an equal or pro rata basis. For example, if a matching pattern is produced in the upper left and upper right quadrants 28, an equal division of the prize awards all four of the participants equally while a pro rata division would only award the prize to the participants whose substrates 10 are in the upper left and upper right quadrants 28.

Due to the speed of modern microprocessors, the second phase search for winning combinations 73 can be performed virtually instantly. Here again, as at the conclusion of the first phase of the game, the game server software 34 determines the amount of each prize and records those participants who share it. Prize amounts, again, are stored in a memory database 32, e.g., in a participant's game account, which can be placed "on account" to be used to offset future game fees and/or from which a check can be drafted and issued to the participant in the amount of the prize.

Preferably, to further add to the excitement of the game, a message area 40 can be included, in which messages from the game server 30, e.g., "IT'S YOUR TURN" or "YOU WON $100!", and/or messages from other participants in the same playing group can be displayed. This feature, essentially, is similar to an Internet chat room that is well known to those skilled in the art. Additionally, the message area can be used for receiving personal email messages from other participants, which does not appear on the chat-room network; for providing additional instructions and/or strategies on how to play the first phase portion of the game; and the like.

Although, the invention has been described in detail including the preferred embodiments thereof,, the invention is not to be construed to be limited to the preferred embodiment. Indeed, such description is for illustrative purposes only, and it is to be understood that changes, modifications, and variations, including improvements, can be made by those skilled in the art without departing from the spirit or scope of the following claims.

For example, in a separate embodiment, during the first phase of play 40, participants do not have to reveal their game pieces sequentially; rather, they can reveal all of their game pieces 16 on their own substrate 10 by clicking on, e.g., a "REVEAL ALL" button 53, that uncovers all of the participant's game pieces 16 at once.

As another example, in a separate embodiment, during the first phase of play, participants can reveal game pieces 16 on their own substrate 10 or the substrates of any of the other participants 30. In this instance, prize amounts are shared between the participant who owns the game substrate 30 on which a three-in-a-row appears and the participant who uncovered the matching game piece 16 to produce the three-in-a-row. Accordingly, participants must play close attention to each of the game substrates 10 and 30 to maximize their chances of winning outright or sharing a prize. This adds to the excitement and the interest in play, which is not found in most online games.

As yet another example, participants can completed their individual, i.e., first, phase of play independently without first joining a group. According to this embodiment, after participants have revealed their game pieces, the participant's virtual game substrate is placed asynchronously into a matrix with the virtual game substrates of, e.g., three other participants. In this embodiment, therefore, there can be virtually a constant stream of participants rather than a fixed number, e.g., nine.

Moreover, although the substrates 10 of only four participants from a playing group are used to populate the matrix 26 and only then in discrete quadrants 28 in the matrix 26, there are more options available. Indeed, statistically, there are a total of 126, i.e., $9!/(5!\times4!)$, combinations of nine participants taken four at a time. Furthermore, of those 126 combinations, the number of possible combinations that include any single participant is 56, i.e., $8!/(5!\times3!)$. Moreover, there are four cycles per combination in the process described above. Accordingly, each participant has 224, i.e., $56\times4$, additional chances to receive a prize using this variation of the second phase of the game.

All totaled, there can be 3024, i.e., $9!/4!$, possible combinations of participants and quadrant locations. Thus, those skilled in art can manipulate equitably the number of combinations of participants and the quadrant locations of the participants making up the combination without violating the scope and spirit of this disclosure.

What is claimed is:

1. An online game of chance that is played by at least one participant, the game comprising:

a first game phase using a virtual game substrate, having a grid, which includes a plurality of playing squares arrayed thereon in a plurality of rows and columns; and a second game phase using a matrix, said matrix comprising a plurality of movable virtual game substrates from the first game phase disposed in an array;

wherein said at least one participant can win a prize during said first game phase if at least three matching game pieces, which are disposed in the playing squares of the grid, are arrayed contiguously in at least one of a row, a column, and a diagonal in the grid; and wherein said at least one participant can win a prize during said second game phase if a combination of game pieces, when arrayed in said matrix, match a predetermined winning array of game pieces.

2. The game as recited in claim 1, wherein each of said plurality of movable virtual game substrates is disposed to populate a first quadrant of the matrix.

3. The game as recited in claim 2, wherein each of said plurality of movable virtual game substrates is movable sequentially to a second, then to a third, and finally to a fourth quadrant of the matrix.

4. The game as recited in claim 3, wherein each of said plurality of movable virtual scratch substrates is movable to said second, third, and fourth quadrants of the matrix in a clockwise direction.

5. The game as recited in claim 1 wherein a first participant can win a prize during said first game phase if said first participant reveals a game piece that, in combination with two or more previously-revealed matching game pieces, produces at least three matching game pieces that are arrayed contiguously in at least one of a row, a column, and a diagonal in the grid on the virtual game substrate of a second participant.

6. The game as recited in claim 1, wherein said at least one participant can win a prize during said second game phase if a combination of game pieces, when arrayed in said matrix, match substantially all of a predetermined winning array of game pieces.

7. The game as recited in claim 1, wherein the game is played online using at least one of the following the Internet, a local area network, a wide area network, a wireless network, a personal desk assistant, and interactive television.

8. A method of playing an online game of chance comprising the steps of:

providing one or more participants with a plurality of virtual game substrates, having a plurality of game pieces that are concealed from view by a virtual covering, wherein said plurality of game pieces is disposed in a plurality of playing squares in a grid;

playing a first game phase, whereby said one or more participants removes said virtual covering from said plurality of virtual game substrates to reveal said plurality of game pieces that is disposed thereunder, to determine whether a substrate is a winning substrate; and playing a second game phase, whereby said plurality of virtual game substrates are combined and movably arrayed in a matrix, to determine whether said combination of virtual game substrates is a winning combination of game substrates.

9. The method as recited in claim 8, wherein said virtual covering is removed by clicking a mouse cursor on one of said plurality of playing squares of said grid.

10. The method as recited in claim 8, wherein said virtual covering is removed from one of said plurality of game squares sequentially to reveal one of said plurality of game pieces at a time.

11. The method as recited in claim 8, wherein said virtual covering is removed simultaneously from each of said plurality of game squares to reveal all of said plurality of game pieces at once.

12. The method as recited in claim 8, wherein the method comprises the further steps of:

arraying each of said plurality of virtual game substrates in one of a first quadrant, a second quadrant, a third quadrant, and a fourth quadrant of said matrix;

transposing each of said arrayed plurality of virtual game substrates to each of said first, second, third, and fourth quadrants; and determining whether said moved plurality of virtual game substrates is a winning combination by comparing each combination of game pieces disposed in said plurality of playing squares of the matrix with a predetermined winning combination of game pieces.

13. The method as recited in claim 12, wherein said arrayed plurality of virtual game substrates is transposed by transposing:

a first game piece disposed in the first quadrant to the second quadrant;

a second game piece disposed in the second quadrant to the third quadrant;

a third game piece disposed in the third quadrant to the fourth quadrant; and a fourth game piece disposed in the fourth quadrant to the first quadrant.

14. The method as recited in claim 13, wherein said arrayed plurality of virtual game substrates is further transposed by transposing:

a first game piece disposed in the second quadrant to the third quadrant;

a second game piece disposed in the third quadrant to the fourth quadrant;

a third game piece disposed in the fourth quadrant to the first quadrant; and a fourth game piece disposed in the first quadrant to the second quadrant.

15. The method as recited in claim 14, wherein said arrayed plurality of virtual game substrates is further transposed by transposing:

a first game piece disposed in the third quadrant to the fourth quadrant;

a second game piece disposed in the fourth quadrant to the first quadrant;

a third game piece disposed in the first quadrant to the second quadrant; and a fourth game piece disposed in the second quadrant to the third quadrant.

16. The method as recited in claim 8, wherein each of said one or more participants reveals his or her plurality of game pieces by removing said virtual covering from his or her own virtual game substrates.

17. The method as recited in claim 8, wherein a first participant reveals his or her plurality of game pieces by removing said virtual covering from one or more virtual game substrates that belong to a second participant.

* * * * *